US012097447B2

(12) United States Patent
Kelly et al.

(10) Patent No.: US 12,097,447 B2
(45) Date of Patent: Sep. 24, 2024

(54) BUBBLE PRODUCING DEVICE

(71) Applicant: LIGHTUPTOYS.COM LLC, Sellersburg, IN (US)

(72) Inventors: Joshua C. Kelly, New Albany, IN (US); Christopher D. Kelly, New Albany, IN (US); Max Armendariz Lalama, Sellersburg, IN (US)

(73) Assignee: LightUpToys.com LLC, Sellersburg, IN (US)

( * ) Notice: Subject to any disclaimer, the term of this patent is extended or adjusted under 35 U.S.C. 154(b) by 0 days.

(21) Appl. No.: 17/335,447

(22) Filed: Jun. 1, 2021

(65) Prior Publication Data

US 2021/0379503 A1 Dec. 9, 2021

(30) Foreign Application Priority Data

Jun. 4, 2020 (CN) ..... 202021000669.8
Jul. 20, 2020 (JP) ..... 2020-002983

(51) Int. Cl.
*A63H 33/28* (2006.01)
*A63H 33/22* (2006.01)

(52) U.S. Cl.
CPC ..... *A63H 33/28* (2013.01); *A63H 33/22* (2013.01)

(58) Field of Classification Search
CPC ..... A63H 33/28
See application file for complete search history.

(56) References Cited

U.S. PATENT DOCUMENTS 1,143,458 A * 6/1915 Stern ..... A63H 33/28 446/24
1,572,409 A * 2/1926 Oldham ..... A63H 33/28 446/24

(Continued)

FOREIGN PATENT DOCUMENTS

CN 110152324 8/2019
CN 2020302586485 10/2020

(Continued)

OTHER PUBLICATIONS

JP2020-025089 (Machine English Translation).

(Continued)

*Primary Examiner* — Eugene L Kim
*Assistant Examiner* — Matthew B Stanczak
(74) *Attorney, Agent, or Firm* — Scott R. Cox; Jessica C. Ronald

(57) ABSTRACT

A bubble producing device that includes a housing with a motor, a pump and an air producing device, all of which are electrically connected. A shaft with two ends, one end of which is connected to said housing and the second end is connectable to a bubble producing solution reservoir. A duct connected on one end to the air producing device and on the other end to a nozzle. The nozzle includes an open inner portion and an outer portion, wherein the outer portion includes a trough which surrounds an outer circumference of the nozzle and includes an outlet and an inlet. The inner portion includes a wiper secured therein. A solution channel pumps solution from the reservoir to the outlet to create bubbles and a recirculation channel pumps excess solution from the inlet back to the reservoir.

11 Claims, 16 Drawing Sheets

(56) References Cited

U.S. PATENT DOCUMENTS 1,962,801 A * 6/1934 Harvey ..... A63H 33/28 446/20
3,124,174 A * 3/1964 Seuthe ..... A63H 33/28 141/284
3,708,909 A * 1/1973 Winston ..... A63H 33/28 446/16
3,733,736 A * 5/1973 Glessner, Sr. ..... A63H 33/28 446/18
3,805,442 A * 4/1974 Matlack ..... A63B 23/18 446/186
3,971,157 A * 7/1976 Gillis ..... A63H 33/28 446/19
4,166,084 A * 8/1979 Shea ..... A61L 9/14 137/87.03
4,274,591 A * 6/1981 Sunshine ..... A63H 29/10 239/722
4,775,348 A 10/1988 Collins
5,035,665 A * 7/1991 Sheng ..... A63H 33/28 D21/402
5,297,979 A * 3/1994 Amron ..... A63H 33/28 239/289
5,452,901 A * 9/1995 Nakada ..... A63H 30/04 446/454
6,022,273 A * 2/2000 Gabai ..... A63H 30/04 345/474
6,024,623 A * 2/2000 Menow ..... A63H 33/28 446/16
6,380,844 B2 * 4/2002 Pelekis ..... H04B 10/1149 446/268
6,953,376 B1 * 10/2005 Kim ..... A63H 33/28 446/175
7,059,930 B2 6/2006 Choi
7,808,385 B2 * 10/2010 Zheng ..... A63H 33/042 340/572.1
7,914,359 B2 3/2011 Thai
8,157,611 B2 * 4/2012 Zheng ..... A63H 30/04 446/298
8,267,736 B2 9/2012 Lam
8,469,766 B2 * 6/2013 Zheng ..... A63H 3/28 446/99
8,926,395 B2 * 1/2015 Zheng ..... A63H 3/28 446/268
10,674,588 B2 6/2020 Kelly et al.
10,738,972 B1 8/2020 Kelly et al.
11,149,932 B1 10/2021 Kelly et al.
11,274,707 B2 3/2022 Kelly et al.
2002/0090878 A1 7/2002 Holmes
2003/0116224 A1 * 6/2003 Crawford ..... A63H 33/28 141/352
2003/0232657 A1 * 12/2003 Levine ..... B65D 81/365 472/137
2004/0142626 A1 * 7/2004 Choi ..... A63H 33/28 446/15
2005/0148276 A1 * 7/2005 LaFata ..... A63H 33/26 446/18
2007/0128975 A1 * 6/2007 Dimitriou ..... A63H 33/22 446/397
2013/0280982 A1 * 10/2013 Golad ..... A63H 29/16 446/193
2014/0141688 A1 * 5/2014 Kelly ..... A63H 33/28 446/15
2014/0364032 A1 * 12/2014 Kelly ..... A63H 33/28 446/15
2015/0343322 A1 * 12/2015 Beavers ..... B01F 35/32025 446/15
2015/0375100 A1 * 12/2015 Kaye ..... A63F 9/24 273/454
2016/0018083 A1 * 1/2016 Kelly ..... A63H 33/22 362/372
2016/0074759 A1 3/2016 Kelly et al.
2016/0377271 A1 12/2016 Kelly et al.
2019/0111358 A1 * 4/2019 Kelly ..... A63H 33/28
2019/0192989 A1 * 6/2019 Kelly ..... A63H 33/28
2020/0054959 A1 * 2/2020 Weigl, Jr. ..... A63H 33/28
2020/0155957 A1 * 5/2020 Clayton ..... A63H 33/28
2021/0379503 A1 * 12/2021 Kelly ..... A63H 33/22
2022/0049842 A1 2/2022 Kelly et al.
2022/0143525 A1 * 5/2022 Lo ..... A63H 29/22
2022/0168662 A1 * 6/2022 Kelly ..... A63H 33/28
2022/0379232 A1 * 12/2022 Kelly ..... A63H 33/28
2023/0277953 A1 * 9/2023 Kelly ..... A63H 33/22 446/15

FOREIGN PATENT DOCUMENTS

| | | |
|---|---|---|
| CN | 2020303185951 | 1/2021 |
| CN | 2020211906063 | 5/2021 |
| CN | 2020306650315 | 5/2021 |
| CN | 2020228706793 | 8/2021 |
| HK | 40012265 | 7/2020 |
| JP | 2020-005392 | 2/2021 |
| JP | 2020-014719 | 4/2021 |
| JP | 2020-025089 | 7/2021 |

OTHER PUBLICATIONS

CN2020211906063 (Machine English Translation).
CN2020228706793 (Machine English Translation).
CN2020306650315 (Machine English Translation).
CN2020303185951 (Machine English Translation).
China National Intellectual Property Administration, Notification of the First Office Action for Chinese Patent Application No. 201810150513.9 (Equivalent to CN110152324) dated Oct. 9, 2021.
U.S. Appl. No. 15/436,886.

* cited by examiner

BUBBLE PRODUCING DEVICE

CROSS REFERENCE TO RELATED APPLICATION

This application claims the benefit of Chinese Utility Model Application No. 202021000669.8 filed on Jun. 4, 2020 and Japanese Utility Model Application No. 2020-002983 filed on Jul. 20, 2020. The entire contents of the above applications are incorporated herein by reference.

FIELD OF THE INVENTION

The device relates to a bubble producing device. More specifically, it relates to an electric bubble producing toy.

BACKGROUND

Bubble producing devices and electric bubble producing devices are known. However, many known devices leak from the overproduction of bubbles or even during normal operations. Accordingly, the devices become less useful or even nonfunctional as a result of this excess solution leaking onto the electric components of the device. Moreover, this leakage results in the bubble solution being deposited on the hands of the user, leading to a non-user-friendly bubble producing device. This leakage also leads to large quantities of bubble solution being wasted and the need for frequent refilling leading to a shortened lifetime of the device. Moreover, these devices tend to overheat as there is no fail-safe for when the speed of the motor is too high.

Further, many known devices do not have a structure that catches excess bubble solution and recirculates this solution through the bubble producing device. If such a structure exists, it is easily broken, which causes excess solution to leak internally.

SUMMARY OF INVENTION

A bubble producing device including a housing containing a motor, a pump, and an air producing device electrically connected to a power source, a shaft with two ends, wherein a first end is connected to said housing, a bubble producing solution reservoir connectable to a second end of said shaft, a duct including a first and second end, wherein the first end is connected to said air producing device, a nozzle secured to said second end of the duct including an inner and outer portion, wherein said outer portion includes a trough with an outlet, and wherein the inner portion includes a wiper secured therein, and a channel comprising a tubular structure with two ends, wherein a first end is submerged within the solution reservoir and a second end is connected to the outlet.

DETAILED DESCRIPTION OF DRAWINGS

FIGS. 1-10 show varying perspectives of a bubble producing device 10. The bubble producing device is any size depending on user demand and includes a bubble solution reservoir 20 that is connectable by a shaft 30 to a housing 50 (See FIG. 1).

Figure 1:
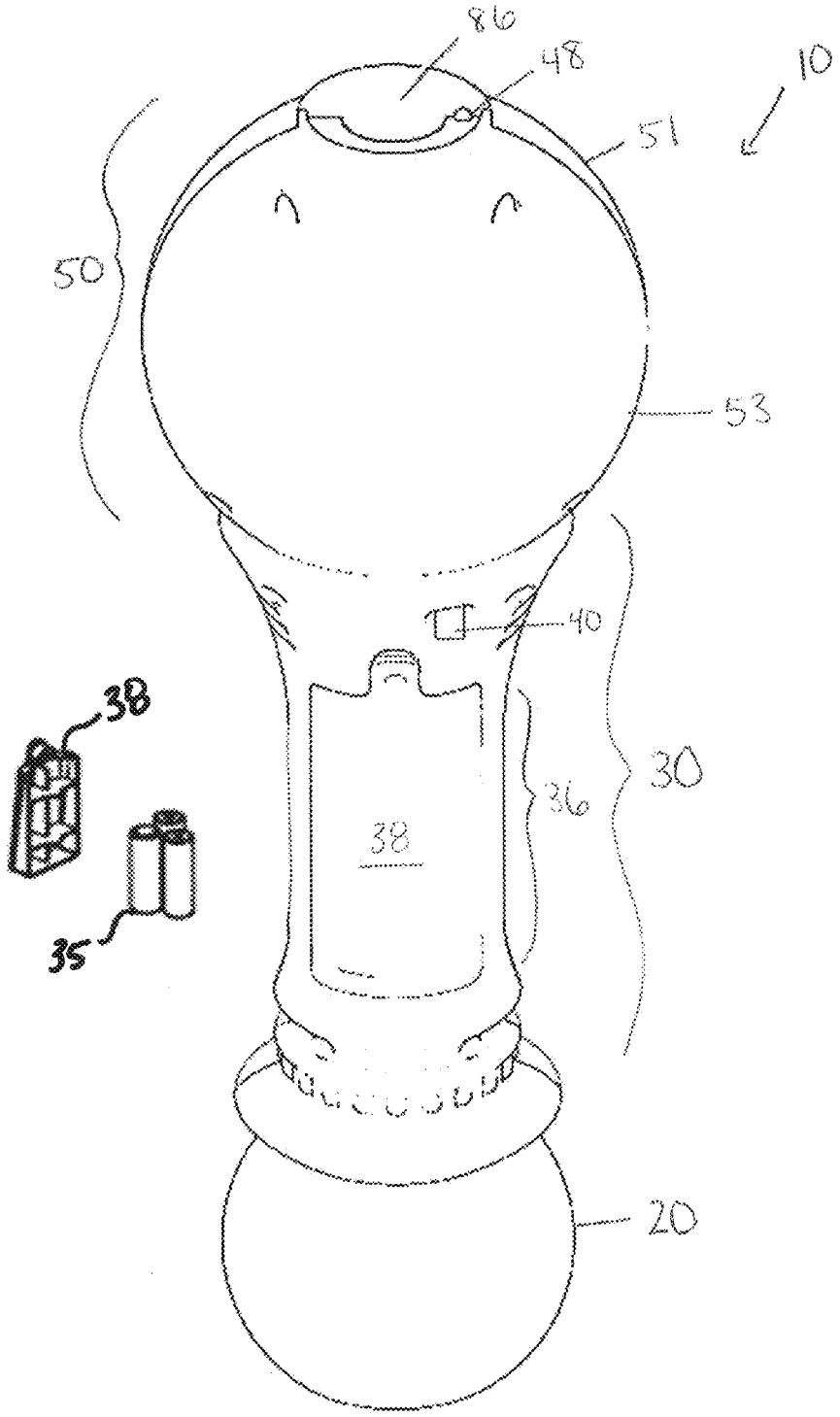
FIG. 1 is a back view of a bubble producing device including a bubble producing solution reservoir connected by a shaft to a housing.

As shown in FIG. 1, the reservoir 20 contains liquid, such as bubble solution, that is capable of creating bubbles. The bubble solution is preferably nontoxic and is advantageous because it is less slippery when it falls to the ground. The reservoir preferably has a flat bottom, so the device 10 can be placed on a surface and not topple over. The reservoir can vary in size depending on the overall size of the device. The reservoir is connected to the shaft 30 by any conventional securing system, for instance by twisting or rotating the reservoir onto the shaft. The reservoir is refillable, which is advantageous as the device can be used indefinitely.

Figure 10:
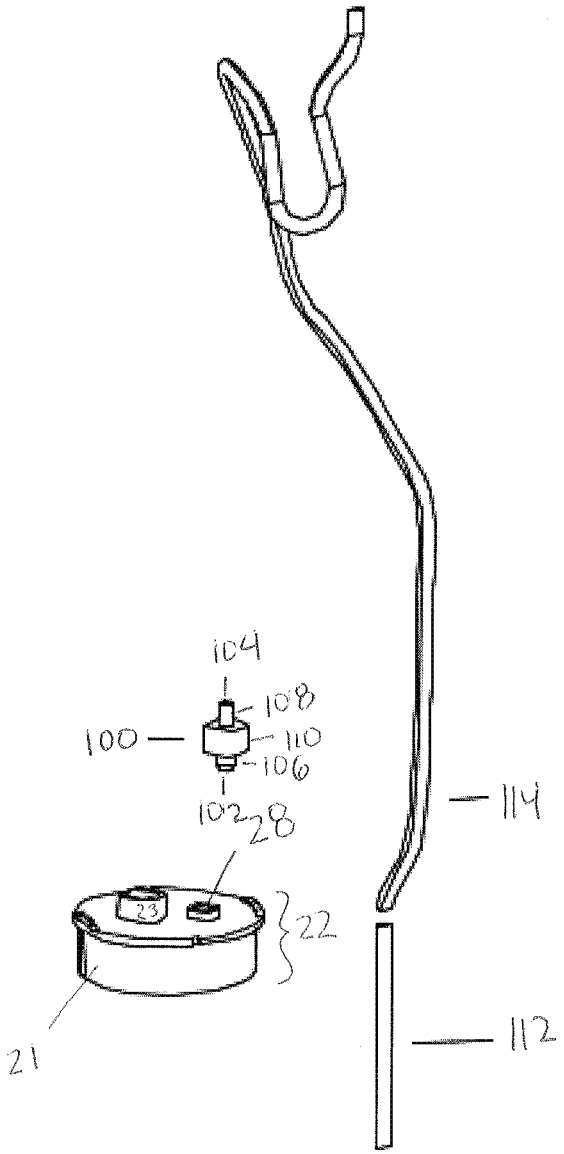
FIG. 10 is a back view of the solution channel and cover of the solution reservoir of the bubble producing device of FIG. 1.
Figure 11:
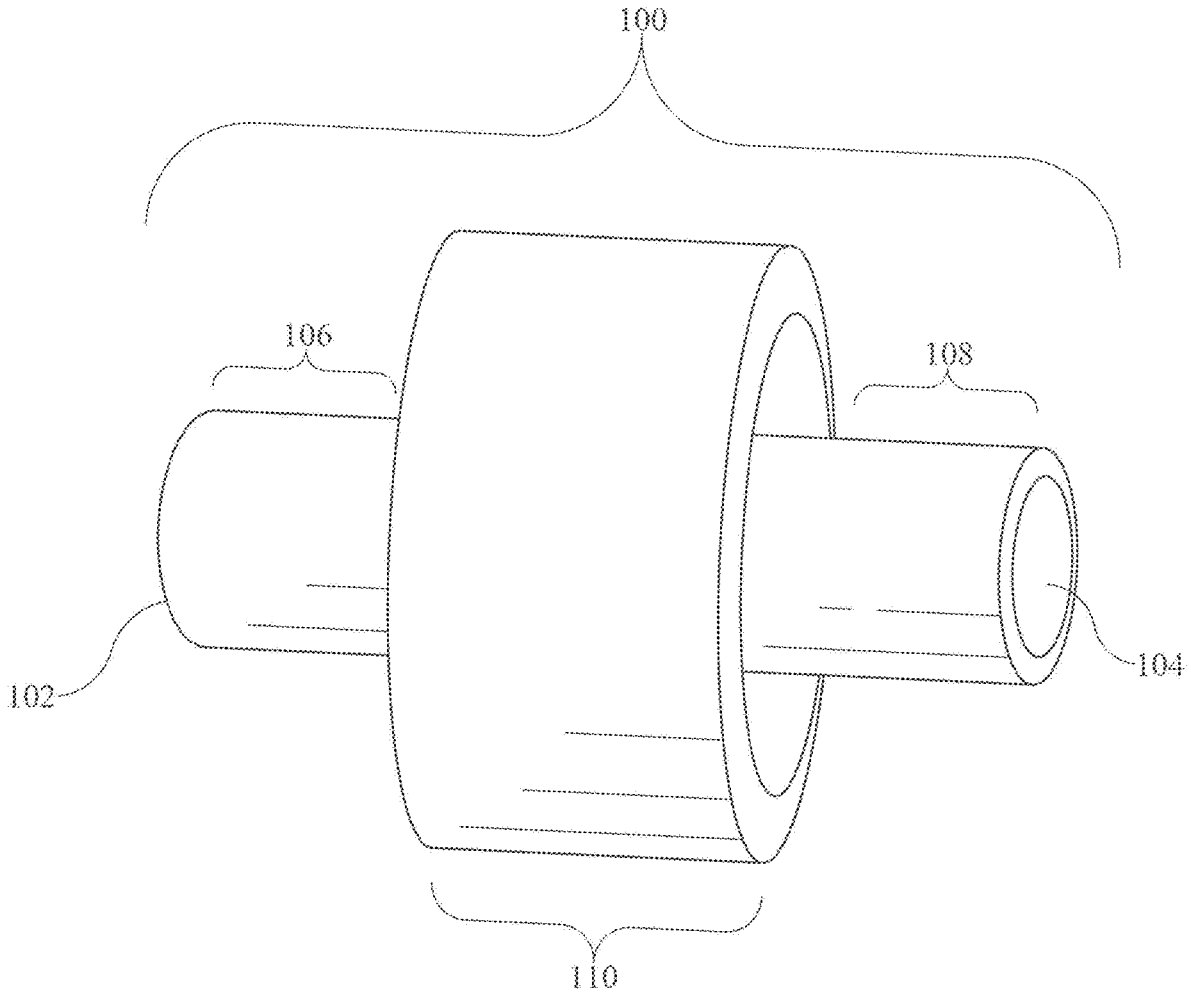
FIG. 11 is side view of a converter that is used in combination with a solution channel of the bubble producing device of FIG. 1.
Figure 12:
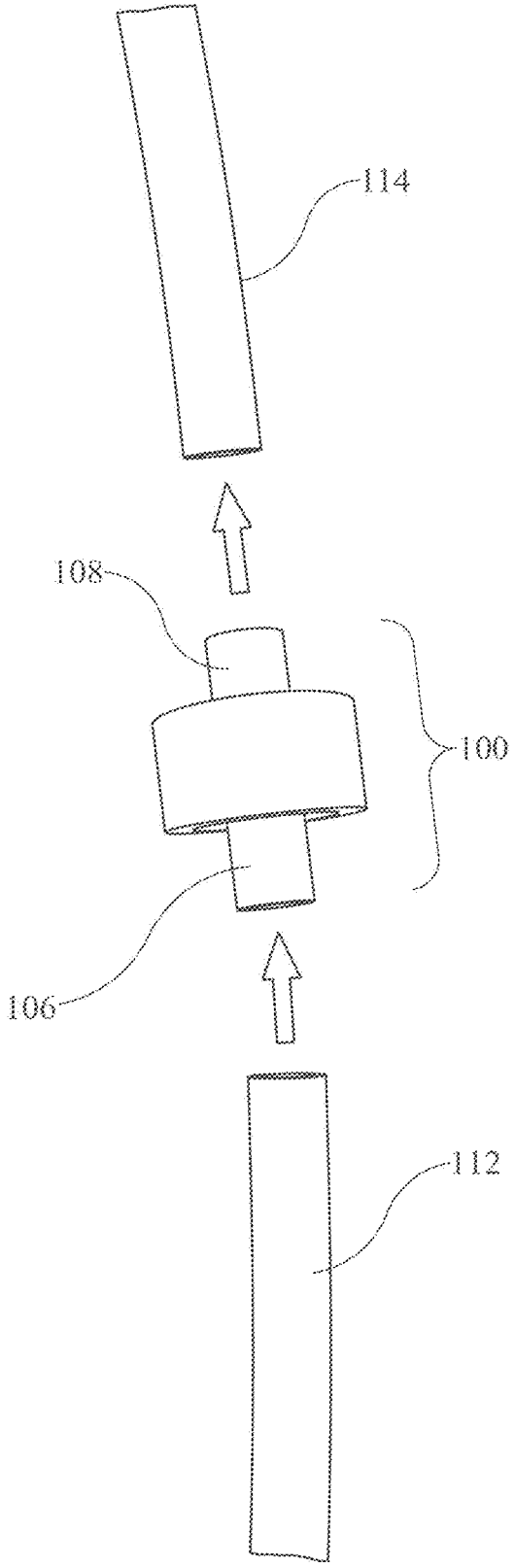
FIG. 12 is a front view of the converter of FIG. 11 with a solution channel that has two pieces with different diameters.
Figure 13:
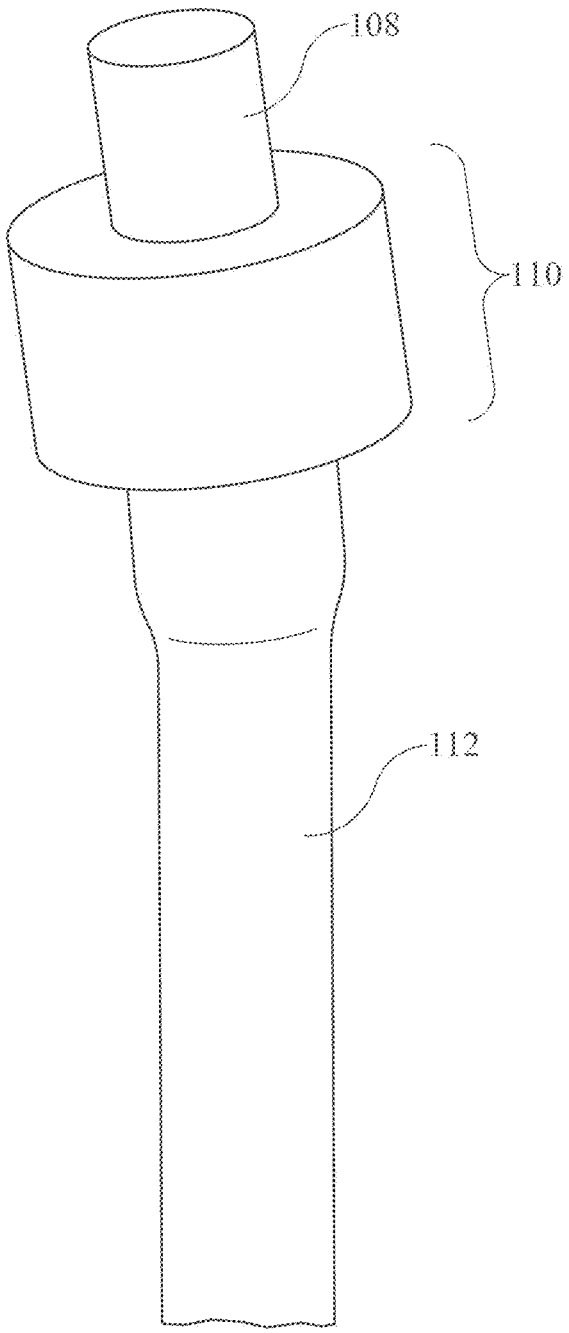
FIG. 13 is a front view of the converter of FIG. 11 connected to a larger diameter piece of the solution channel.
Figure 14:
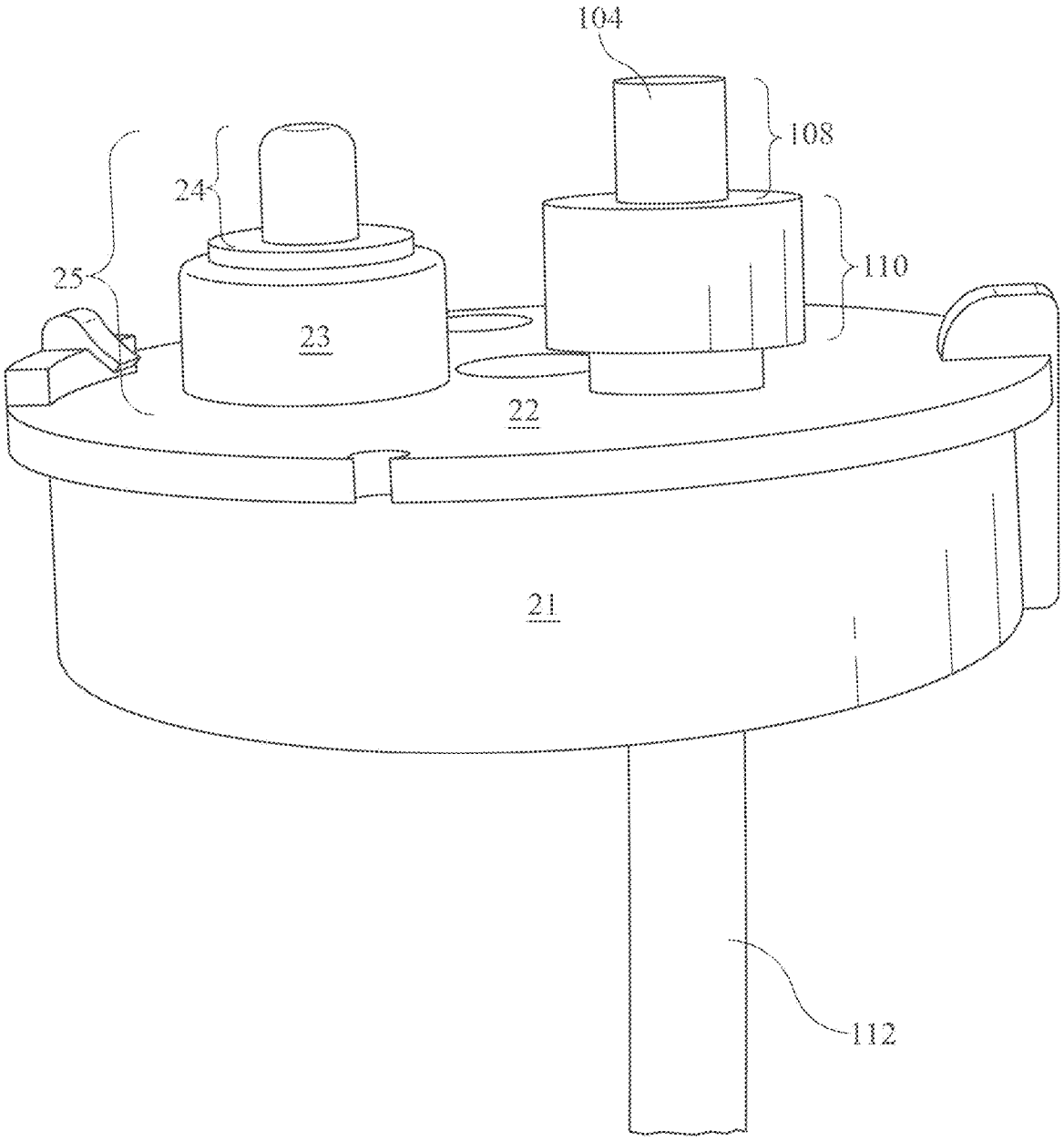
FIG. 14 is a front view of a reservoir cover of the bubble producing device of FIG. 1 connected to the converter and larger diameter piece of the solution channel shown in FIG. 13.
Figure 15:
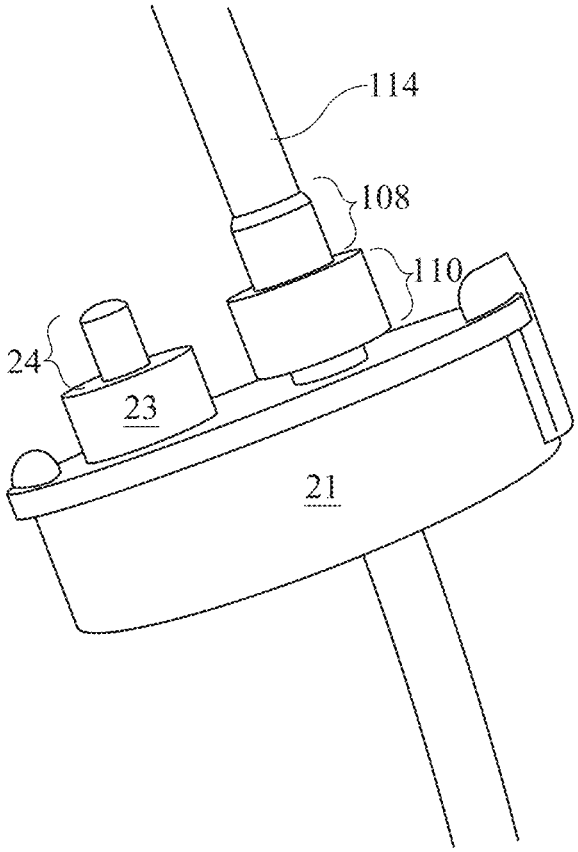
FIG. 15 is a front view of the components shown in FIG. 14, wherein the converter is further connected on a second end to a smaller diameter piece of a solution channel.
Figure 16:
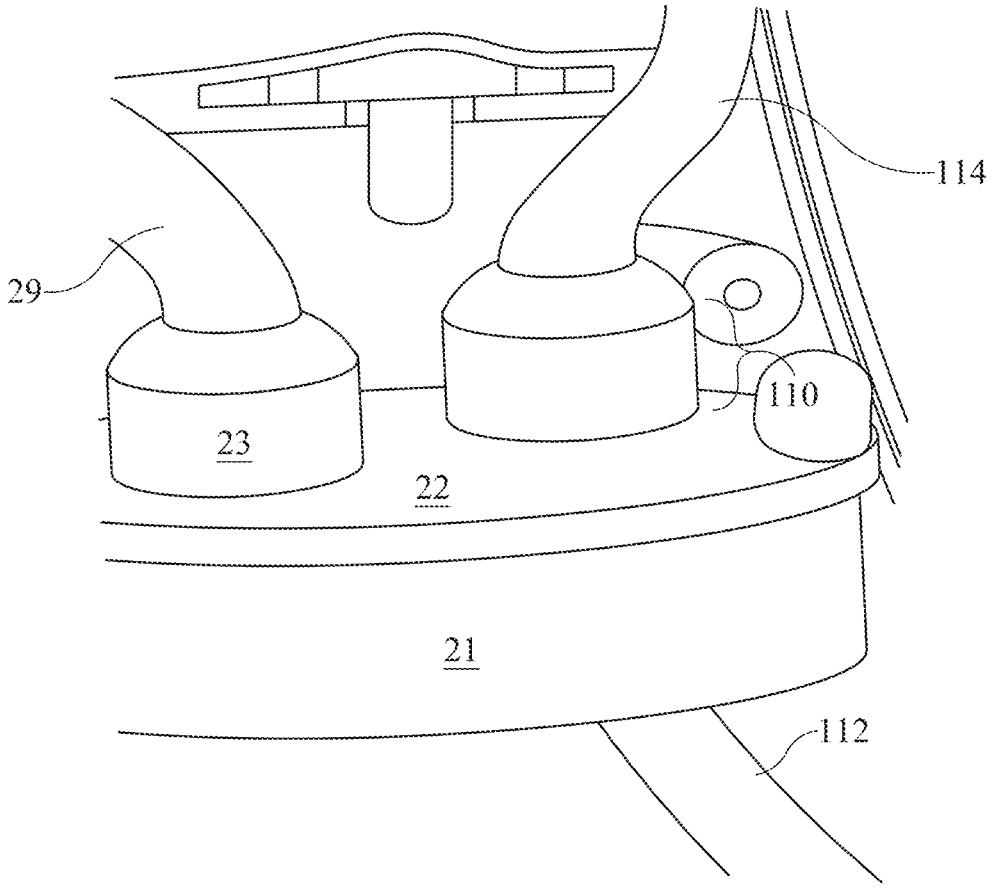
FIG. 16 is a front view of the reservoir cover connected to a solution recirculation channel and a solution channel.

As shown in FIGS. 10, 15 and 16 the reservoir 20 includes a cover 22, that connects to a top portion thereof, and prevents solution from spilling out of the reservoir into the shaft 30. One way in which the cover connects to the reservoir is via sides 21 that protrude downwardly from the cover and secure within the reservoir or around the reservoir. The cover includes an opening 28 for the connection of a solution channel 26 through which solution submerged within the reservoir is pumped or passed. The channel is connected to the opening by conventional methods and one end of the channel is located within the solution of the reservoir. In this embodiment, the channel includes a tubular structure that runs vertically from the reservoir, through the shaft 30, through a pump 60 with a gearbox 62, which are secured within the housing 50, and connects to a nozzle 72 secured in a top portion of the housing.

As shown in FIGS. 10, 15 and 16 the opening 28 may be connected to or include a converter 100. As shown in FIGS. 10-15 the converter includes a first end 102 and a second end 104, and each end includes a tip 106, 108. In this embodiment, the solution channel includes two tubular potions of differing diameters that are connected via the converter. As shown in 12-16, the larger diameter channel 112 connects to the tip of the first end of the converter. The larger diameter channel preferably has a larger inner diameter through which the solution is passed. The end of the larger diameter channel that is not connected to the converter is connected within the solution reservoir 20. The converter can be located anywhere within the length of the solution channel 26 but is preferably connected to or secured into the opening in the cover of the reservoir. Further, the recirculation channel 29 can include a converter therein. The converter can be form fitted into this opening or secured, for instance, via glue. The second end 104 of the converter also includes a tip 108 that is connected to a smaller diameter solution channel 114 that is of a smaller diameter than the larger diameter channel. The smaller channel is reduced in diameter from the larger channel by at least ten percent, preferably about ten to seventy percent, most preferably about ten to fifty percent. In this embodiment, the end of the smaller diameter channel that is not connected to the converter runs vertically through the shaft 30 through a pump 60 with a gearbox 62 secured within the housing 50. The solution within the reservoir is pumped through this channel and the channel eventually merges with and connects to an outlet 78 located within a trough 76 of the nozzle 72 of the device 10.

As shown in FIGS. 10-15 the converter 100 includes a middle body portion 110 that is located between the tips 106, 108 of the converter. The converter is molded as one continuous piece during production. The larger and smaller diameter solution channels 112, 114 are suction fitted onto the respective tips of the converter and can be further secured by other methods. The middle body portion aids in this securement.

The diameter of the smaller diameter solution channels 114 is of a reduced size to reduce the quantity of solution that passes through the channel, which ultimately produces the desired drip rate of the fluid onto the trough 76 of the nozzle 72. The converter 100 functions to reduce the quantity of the solution and the size of the opening through which the solution passes. The converter reduces the quantity of passing solution by at least ten percent, preferably about ten to seventy percent, most preferably about ten to fifty percent. Regardless of use of the converter or not, the tubular structure of the channel aids in producing the preferred drip rate of the solution onto the trough to create the desired number and quality of bubbles.

As shown in FIGS. 10, 15 and 16 the cover 22 of the reservoir 20 also includes a recirculation channel connection device 25 that includes a tip 24, that is connected to the cover by a body portion 23. The converter 100 can be used in conjunction with or in place of the recirculation channel connection device. The tip connects to a solution recirculation channel 29 that includes a tubular structure that runs vertically downward through the shaft 30 to permit excess solution produced during operation of the device 10 to drain back into the reservoir for reuse. The solution recirculation channel is advantageous because it recycles solution, so it is not wasted. Further, the recirculation channel collects excess liquid that is caught in trough 76 of the nozzle 72 and safely returns it to the solution reservoir. This prevents leakage of the excess solution into the inner electronics of the device. The body portion of the recirculation channel connection device includes a ball valve or ball bearing (not shown), so that if a user turns the device upside down, liquid is prevented from leaking out of the reservoir. Moreover, a converter 100, as discussed above, can be used in combination with the solution recirculation channel.

As shown in FIG. 1, the shaft 30 is preferably connected to a top portion of the reservoir 20 via a twisting or screwing mechanism. The shaft is enclosed and is designed to act as a handle for the user to comfortably hold the device 10. The shaft is preferably made of a lightweight, but durable, material, such as plastic that can withstand being dropped without breaking. The shaft is hollow and can be made of one monolithic piece or may consist of a front and back cover secured together, for instance via screws. The shaft preferably includes a power source for operation of the device, although the power source can be located anywhere within the device 10. The power source includes batteries 35, which are secured within a battery compartment 36, which in one embodiment is located on a back side of the shaft. The battery compartment includes a casing 38 that secures the batteries within the compartment, for instance via screws. The batteries are electrically connected to a switch 40 that is palpable to a user through an outlet 42 located in a surface of the shaft. In one embodiment, the battery compartment includes a fuse that protects the power source from overheating by cutting the power source if temperature rises above safety requirements. This switch is multi-functional and thus can control multiple settings of various electrical operations of the device 10. As shown in FIGS. 1-4, for example, the device includes an LED (s) 48 secured within the device, which LEDs may vary in color, luminosity, and intensity. In one manner of operation, when a user pushes the switch once, it illuminates all the LEDs. If a user pushes the switch again, the LEDs flicker. If the user pushes the switch again, the LEDs change color. These functions are not meant to be exhaustive. Furthermore, the switch can control other functions of the device, such as the speed at which the bubbles are produced.

Figure 4:
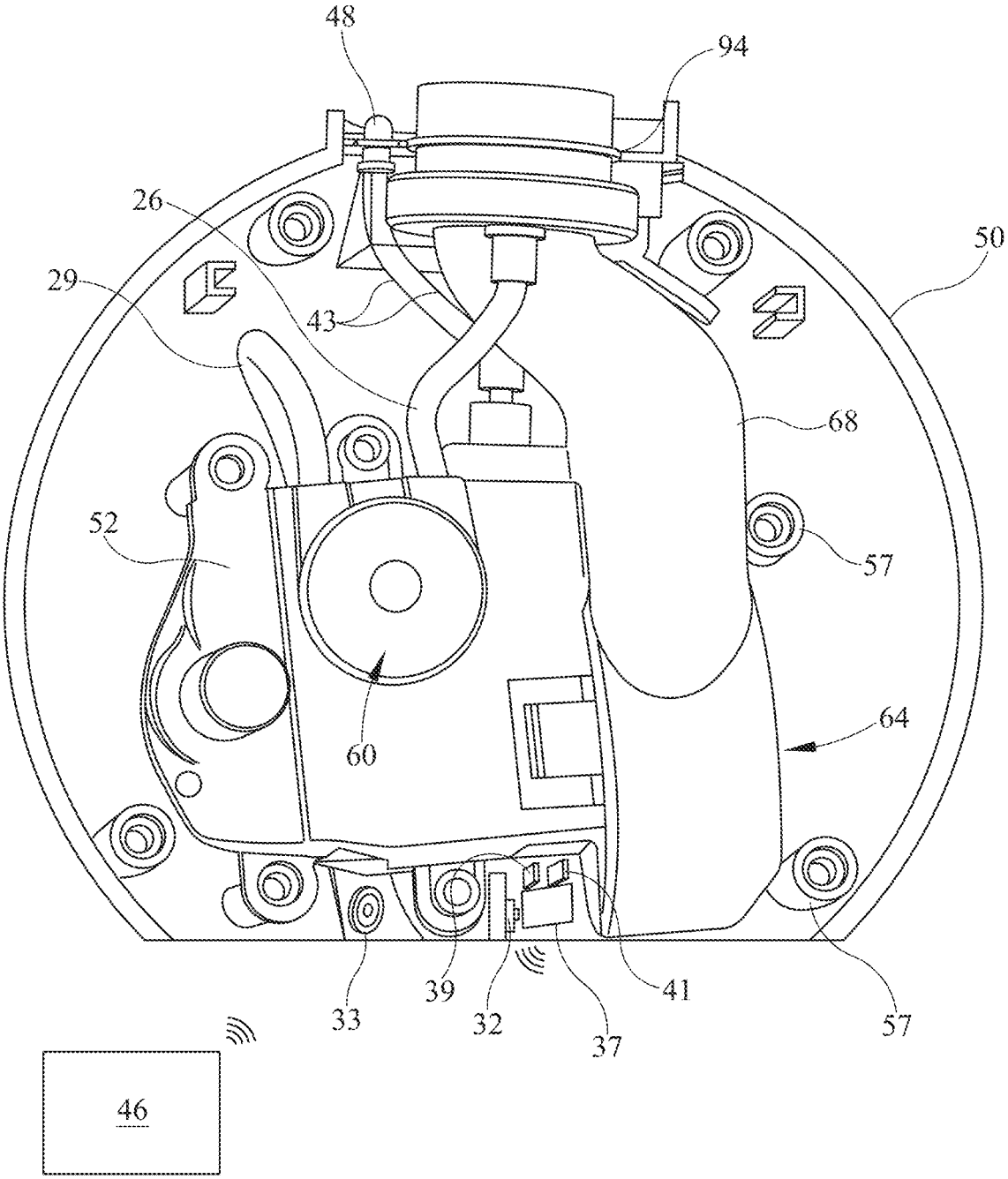
FIG. 4 is an open view of the housing of the bubble producing device of FIG. 1 with electrical components secured within an enclosure.
Figure 6:
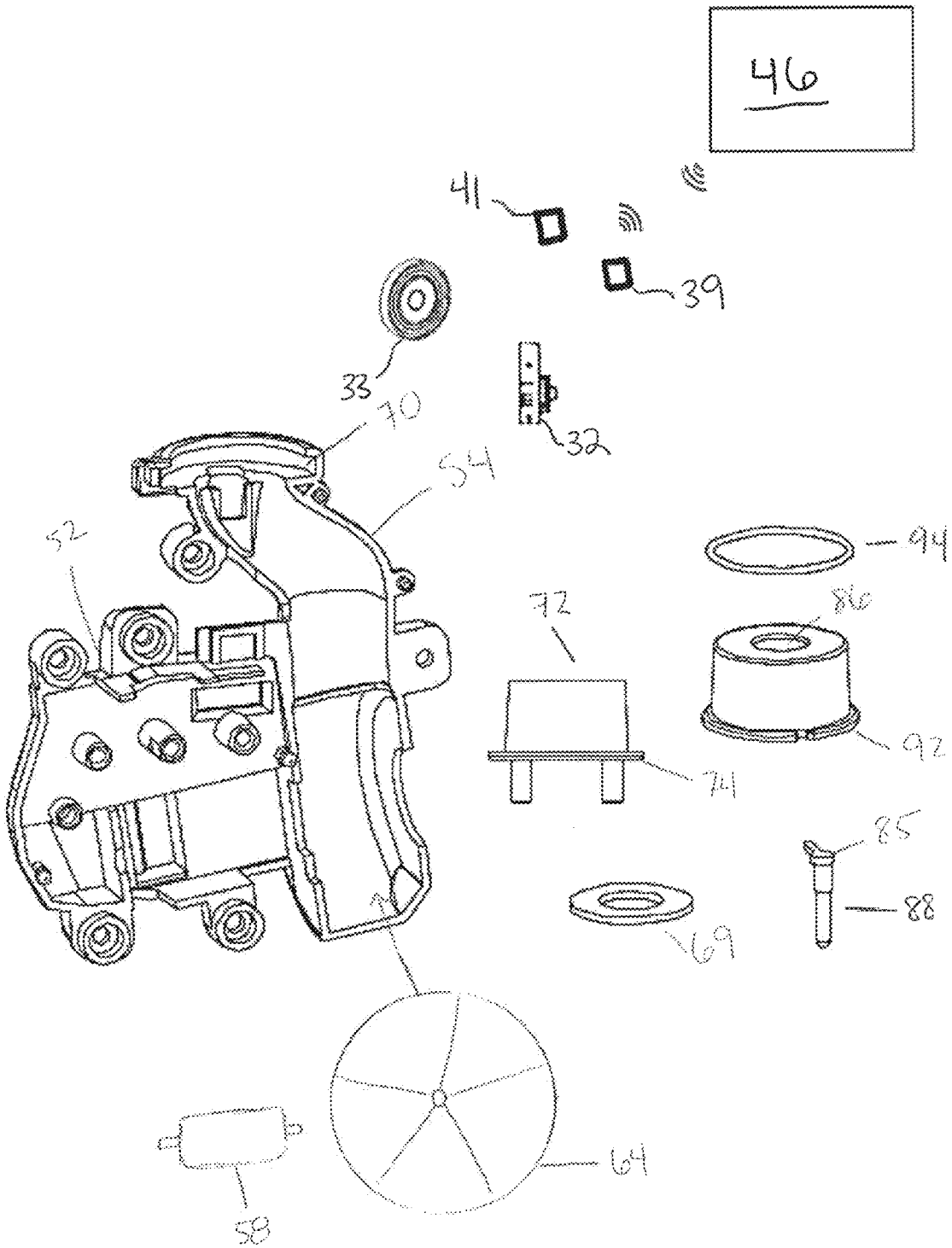
FIG. 6 is a back, open faced view of the enclosure of the bubble producing device of FIG. 1 with the nozzle, a nozzle cover and a wiper mechanism.

The device 10 includes circuitry or control circuitry 37, such as a printed circuit board, that controls the various electrical operations of the device, as shown in FIG. 4. In addition, or in place thereof, the switch 40 can be replaced with a software or signal-controlled switch that is controlled by an internal controller and circuitry of the device 10 and which can be communicatively activated by a remote device. As shown in FIGS. 4 and 6, the switch or other circuit can also incorporate activation through embedded instructions and or receipt of activation signals received by a receiver 41 and included electronics and circuitry. For example, the device can include a receiver for receiving signals which activates the illumination or bubble producing features of the device. The switch or other circuit further incorporate proximity detection devices, such as, for example, RFID or other types of electronics, which sense location, proximity or other wireless operations which provide instructions for or instruct illumination or other various functions of the device. Such devices include instructions and circuitry operable to detect location in respect to a transmitted beacon. As shown in FIG. 4, the device includes a vibrational element 32 or speaker 33 that plays sound through a speaker located within the device.

For example, as shown in FIGS. 4 and 6, the device 10 may automatically activate upon nearing a display 46, feature, attraction, or other location within an amusement park which is transmitting a unique beacon which, when received by the device, causes the device to illuminate or produce bubbles in a predetermined manner. Other possible automated instructions include emitting colors, playing predefined audio stored in memory of the device or received by the receiver of the device, playing signals which are streamed and received by the integrated receiver, and similar functionality.

In one embodiment, as shown in FIGS. 4 and 6, the device 10 includes a sender 39 that transmits a signal to a display 46, feature, attraction of other location within an amusement park. Accordingly, when a user with the device nears a display, feature, attraction, or other location which can receive a unique beacon being sent from the device, the display, feature, attraction etc. illuminates in a predetermined manner.

As shown in FIG. 4, the shaft 30 includes wiring 43 that electrically connects the power source to the electrical components of the device 10, most of which are secured within the housing 50.

Figure 2:
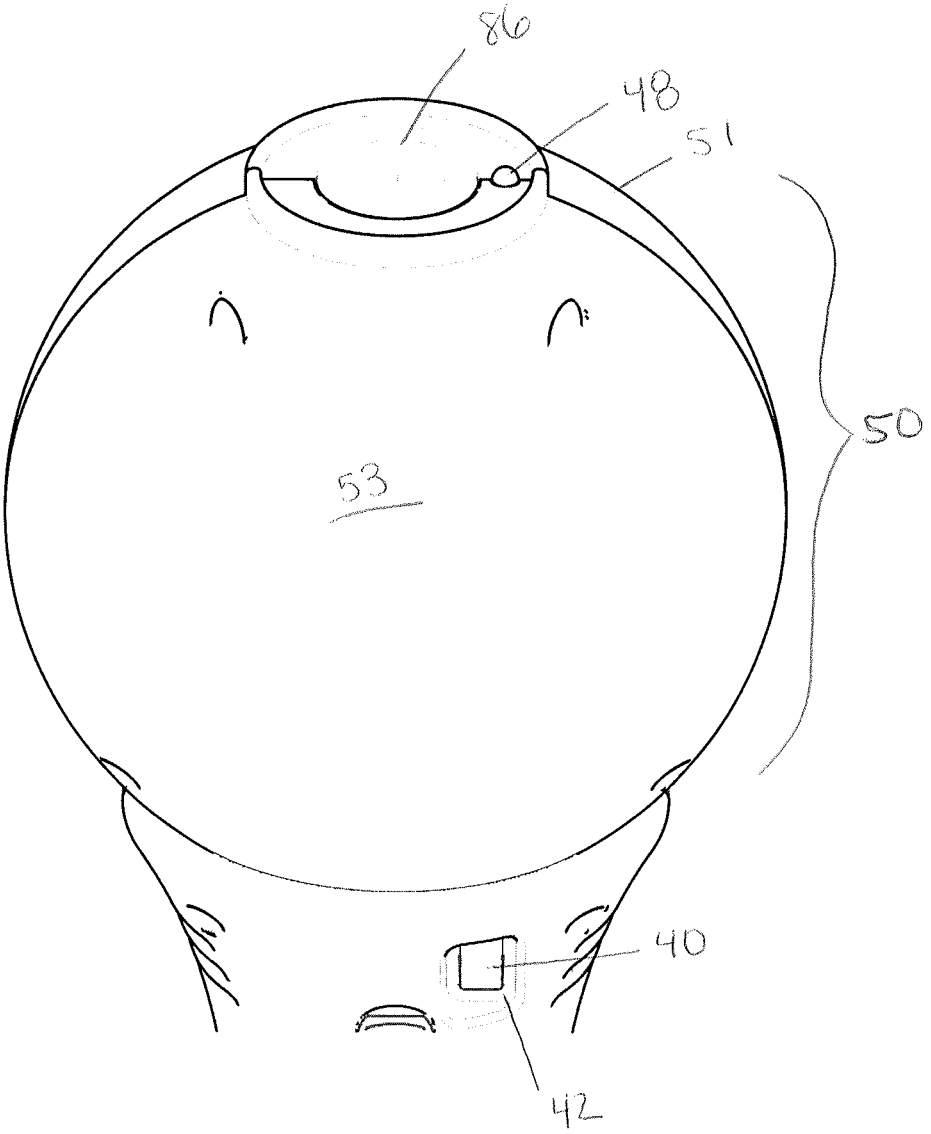
FIG. 2 is a back, perspective view of the housing of the bubble producing device of FIG. 1.
Figure 3:
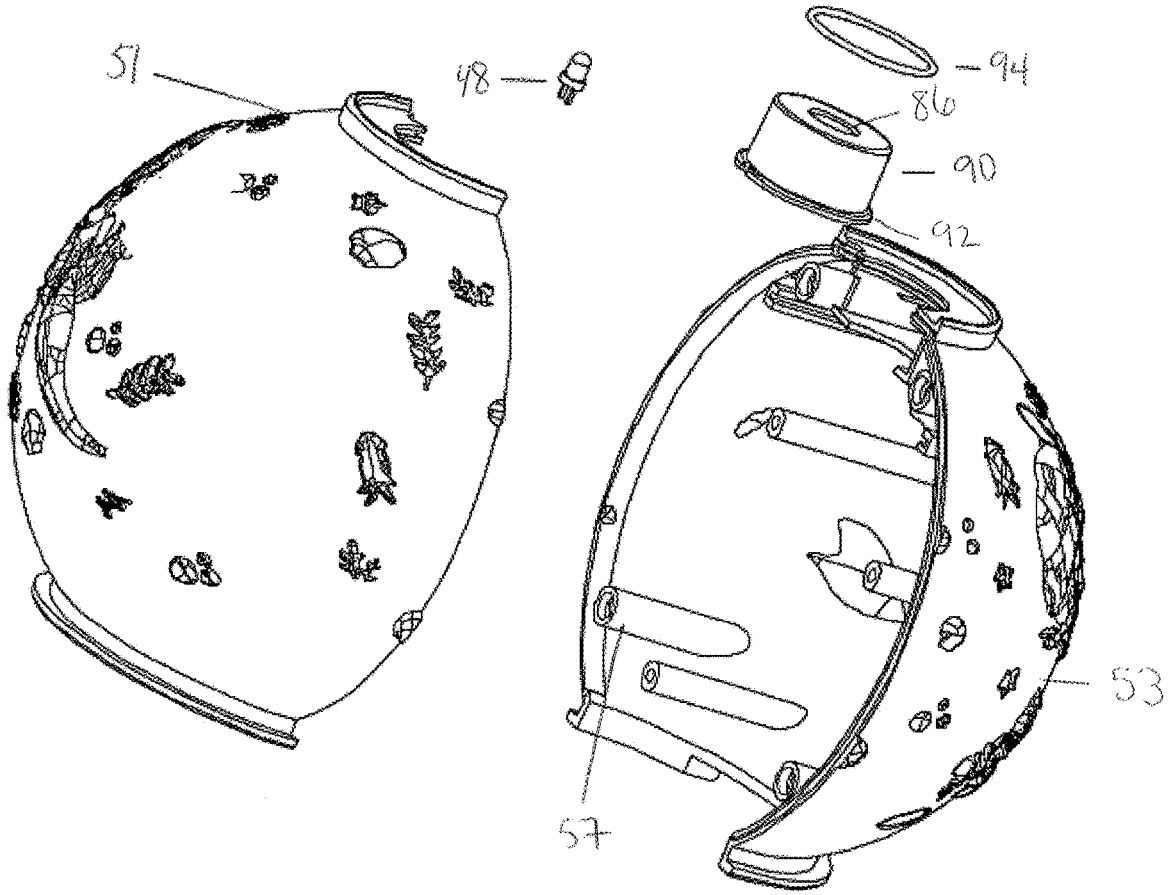
FIG. 3 is an open view of the housing with a nozzle of the bubble producing device of FIG. 1.
Figure 5:
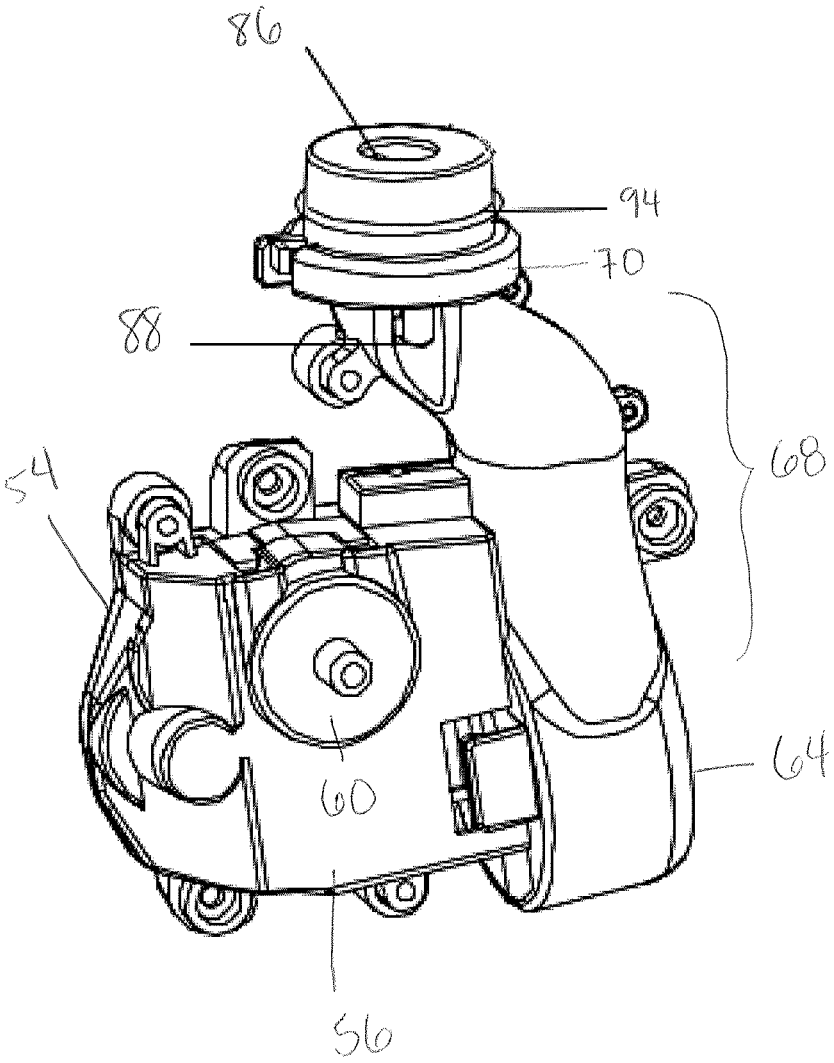
FIG. 5 is a back view of the enclosure that contains the electrical components of the housing of the bubble device of FIG. 1.
Figure 9:
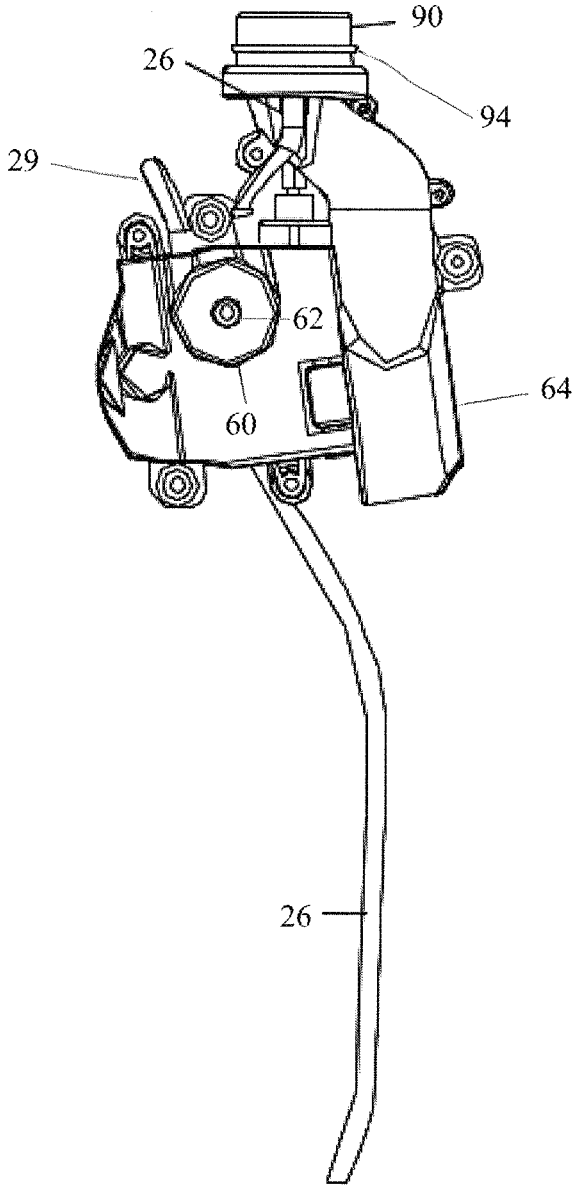
FIG. 9 is a back view of the enclosure, nozzle and solution channel of the bubble producing device of FIG. 1.

As shown in FIGS. 1-3, the housing can include one monolithic piece of material, made, for example, of plastic, or can include a front 51 and back 53 casing that are secured together, for example by screws. The housing can be any shape or size. As shown in FIGS. 4, 5 and 9, the inner contents of the housing are secured within an enclosure 52, which enclosure is secured to an inner surface of the housing. This enclosure is water resistant or waterproof and advantageously aids in protecting the electrical components from being damaged by liquid. As shown in FIG. 4, the enclosure is secured via screws to various pegs 57, which prevents the enclosure from shifting within the housing.

As shown in FIG. 4-6, the enclosure 52 is one piece or includes a front cover 54 and a back cover 56, which are secured together, for instance via screws. The enclosure is configured in any predetermined shape so that, when the front and back covers are secured together, the various components therein are secured in place. The enclosure is configured to contain a motor 58 that is electrically connected to a pump 60 with a gearbox 62 and an air producing device 64. The motor can be any type of motor that most effectively produces the amount of energy needed to create the precise number of rotations necessary to generate the desired quantity of bubbles. Advantageously, the rotational speed of the motor is reduced to a specific rpm so that there is less solution on the nozzle 72 of the top portion of the device, which avoids solution overflow into the device. Further, this motor also generates the necessary air flow rate to create the desired quantity of bubbles. Further, the device advantageously uses less electric current because of the slowed speed of the motor, therefore increasing battery life of the device.

To further aid in producing the desired size and quantity of bubbles is the type of pump 60 used, which is preferably a peristaltic pump. This pump is connected to the gearbox 62, which includes a plurality of gears for controlling the speed of the pump to produce the correct number of bubbles per minute. The pump operates in combination with the gearbox, which draws the bubble solution from the reservoir 20 through the channel 26. The channel extends from the reservoir, through the shaft 30, the pump and the gearbox. A second end 27 of the channel secures to an outlet 78 located in a trough 76 of a nozzle 72. The air combines with the solution close to the discharge orifice 86 of a nozzle cover 90 and is advantageous in creating the desired quantity and size of bubbles.

The motor 58 is electrically connected to the air producing device 64. The air producing device can be any device that produces an air stream with the velocity needed to project the solution through the discharge orifice 86 of the nozzle cover 90. The air duct is a hollow tube that is secured to, part of, or formed by the enclosure 52. The air duct is bent at an angle to aid in creating in the precise number of bubbles to not overheat the device.

Figure 7:
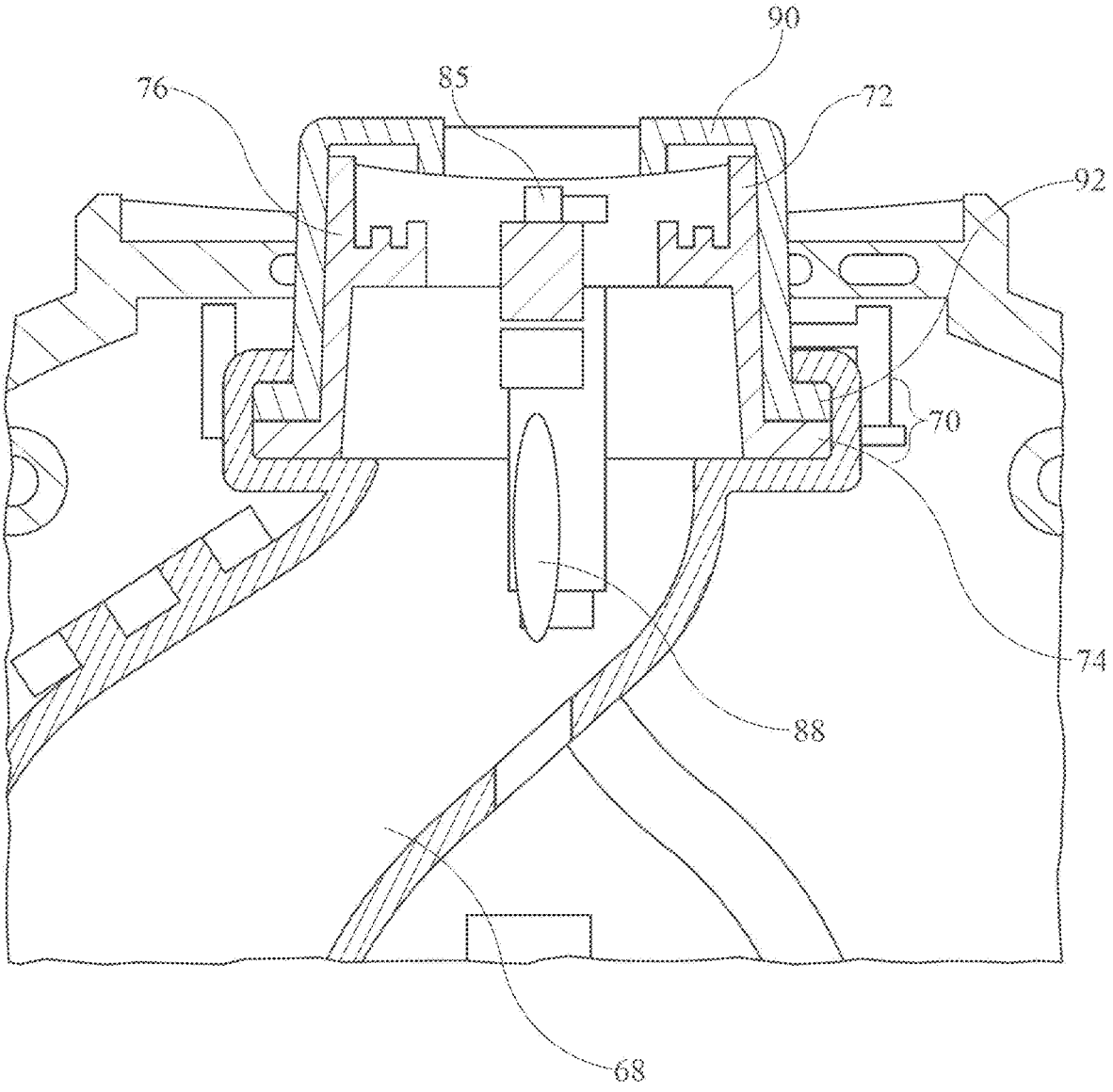
FIG. 7 is a cut-away view of the nozzle, nozzle cover and air duct secured within the housing of the bubble producing device of FIG. 1.
Figure 8:
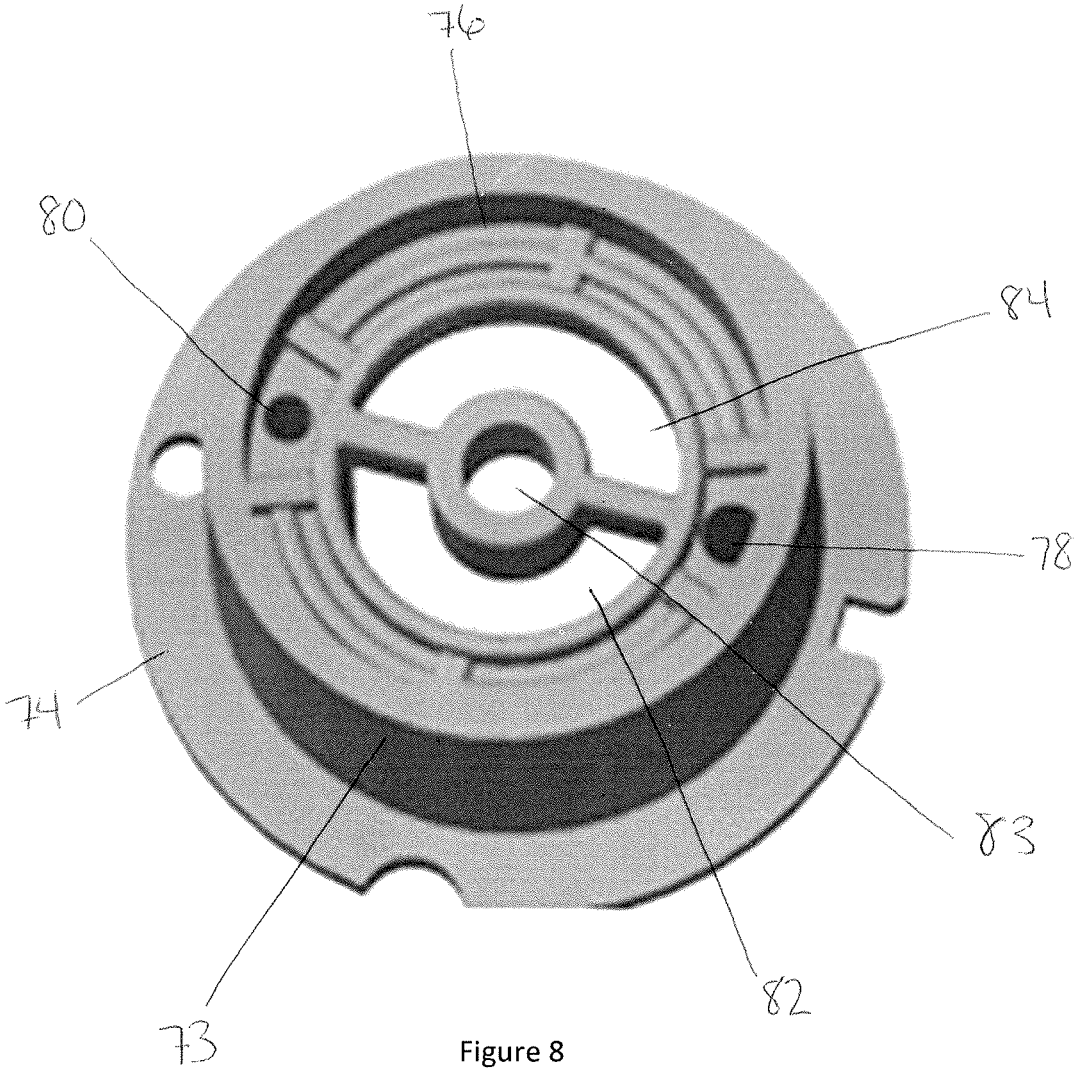
FIG. 8 is a top perspective view of the nozzle of the bubble producing device of FIG. 1.

As shown in FIG. 7, a top portion of the air duct 68 is connected to or includes a bracket-shaped shelf 70. The bracket shape of the shelf is manufactured to securely fit a base portion 74 of the nozzle 72 and a base portion 92 of the nozzle cover 90. The base of the nozzle is secured underneath the base of the cover, which fit together snuggly in the shelf. If further reinforcement is needed, screws can be utilized or a nozzle sealing sheet 69 may be used to seal the bases within the shelf. Extending from the base of the nozzle is an upper portion 73, which includes a trough 76 that surrounds the outer circumference of the upper portion of the nozzle. This trough includes an outlet 78 to which the bubble solution channel 26 connects and an inlet 80 to which the recirculation channel 29 connects. As shown in FIG. 9, each channel connects to an underside of the inlet and outlet. As shown in FIG. 8, inwardly located from the trough are two semicircle openings 82, 84. Air from the air duct is pushed upward through these two semicircle portions. Although these two open semi-circle portions can be any shape, the semi-circle shape is most beneficial for the 360-degree rotation of the wiper 85, which is centrally located within the nozzle via a central portion 83. The wiper shaft 88 is secured within the central portion and extends into the housing 50. When rotating, the wiper extends to the trough and rotates over the two semicircle openings to create bubbles. For example, in use, a user turns on the bubble device 10, which activates the internal electronic components of the device, such as the motor 85, the air producing device 64 and the pump 60. Solution is pumped from the solution reservoir 20 via the solution channel through the shaft 30 and to the outlet located within the trough of the nozzle. Solution then collects in the trough and the as the wiper rotates 360 around the entire trough, a film is created on the two semi-circle portions. Subsequently, air from the air producing device is pushed upwardly through the air duct and beneath the two semicircle portions. The air pushes the film into a bubble, which bubble is pushes out of the discharge orifice 86 in the nozzle cover. Further secured to an outer portion of the nozzle cover is a gasket 94 or searing device that presses against the housing to make the device water resistant. This gasket advantageously prevents any liquid from entering the device.

While several embodiments of the present invention have been shown and described, it is understood that many changes and modifications can be made thereto without departing from the scope of the inventions as disclosed herein.

LISTING OF ELEMENTS

Bubble producing device 10
Bubble solution reservoir 20
Reservoir cover sides 21
Reservoir cover 22
Body portion of recirculation channel connection device 23
Tip of recirculation channel connection device 24
Recirculation channel connection device 25
Solution channel 26
Second end of solution channel 27
Opening in cover for solution channel 28

Recirculation channel 29
Shaft 30
Vibrational element 32
Speaker 33
Batteries 35
Battery compartment 36
Control circuitry 37
Battery compartment casing 38
Sender 39
Switch 40
Receiver 41
Outlet for switch 42
Wiring 43
Display 46
LEDS 48
Housing 50
Front casing of housing 51
Enclosure 52
Back casing of housing 53
Front cover of enclosure 54
Back cover of enclosure 56
Pegs of housing 57
Motor 58
Pump 60
Gearbox 62
Pump 60
Gearbox 62
Air producing device 64
Air duct 68
Nozzle sealing sheet 69
Bracket-shaped shelf of air duct 70
Nozzle 72
Upper extending portion of nozzle 73
Base portion of nozzle 74
Trough 76
Outlet for solution channel 78
Inlet for recirculation channel 80
Semicircle openings 82, 84
Central portion for wiper 83
Wiper 85
Discharge orifice 86
Wiper shaft 88
Nozzle cover 90
Base portion of nozzle cover 92
Gasket 94
Converter 100
First end of converter 102
Second end of converter 104
Top of first end 106
Tip of second end 108
Larger diameter channel 112
Smaller diameter channel 114

The invention claimed is:

1. A bubble producing device comprising:

a housing containing a motor, a pump, and an air producing device;

a shaft with two ends, wherein a first end is connected to said housing;

a bubble producing solution reservoir connectable to a second end of said shaft;

a duct comprising a first and second end, wherein the first end is connected to said air producing device;

a nozzle secured to said second end of the duct comprising an inner and outer portion, wherein said outer portion includes a trough with an outlet, and wherein the inner portion includes a wiper secured therein;

a channel comprising a tubular structure with a first and second end, wherein the first end is submerged within the solution reservoir and the second end is connected to the outlet; and a converter connected between the first and second end of the channel, wherein the diameter of the channel between the first end and the converter is larger than the diameter of the channel between the converter and the second end by at least ten percent.

2. The bubble producing device of claim 1, further comprising a nozzle cover secured adjacent to the nozzle, wherein the nozzle cover comprises a discharge orifice and a gasket secured around an outer edge thereof.

3. The bubble producing device of claim 1, further comprising LEDs secured within the housing.

4. The bubble producing device of claim 1, wherein the motor, pump, air producing device, and air duct are secured within an enclosure secured within the housing.

5. The bubble producing device of claim 1, wherein the inner portion includes two open semicircle portions that surround the wiper.

6. The bubble producing device of claim 1, wherein the wiper rotates 360 degrees around the inner and outer portion of the nozzle.

7. A bubble producing device comprising:

a housing containing a motor, a pump, and an air producing device;

control circuitry secured within the housing, wherein the circuitry includes a wireless communication system including a sender and a receiver;

a vibrational element and a speaker secured within the housing, wherein the vibrational element and the speaker are activated via a unique beacon within a proximity of the device;

LEDs secured within the housing, wherein the LEDs and bubble production of the device are activated by the unique beacon;

a shaft with two ends, wherein a first end is connected to said housing;

a bubble producing solution reservoir connectable to a second end of said shaft;

a duct comprising a first and second end, wherein the first end is connected to said air producing device;

a nozzle secured to said second end of the duct comprising an inner and outer portion, wherein said outer portion includes a trough with an outlet and an inlet, and wherein the inner portion includes a wiper secured therein;

a channel comprising a tubular structure with two ends, wherein a first end is submerged within the solution reservoir and a second end is connected to the outlet; and a second channel comprising a tubular structure with two ends, wherein one end is connected to the inlet and the other end is within the solution reservoir, wherein the second channel comprises a converter connected therein between the two ends of the channel, wherein one end comprises a larger diameter than the other end of the channel.

8. The bubble producing device of claim 7, further comprising a nozzle cover secured adjacent to the nozzle, wherein the nozzle cover comprises a discharge orifice and a gasket secured around an outer edge thereof.

9. The bubble producing device of claim 7, wherein the motor, pump, air producing device, air duct, control circuitry, vibrational element, and speaker are secured within an enclosure secured within the housing.

10. The bubble producing device of claim 7, wherein the inner portion includes two open semicircle portions that surround the wiper.

11. The bubble producing device of claim 7, wherein the wiper rotates 360 degrees around the inner and outer portion of the nozzle.

* * * * *